US007578340B2

(12) United States Patent
Förster et al.

(10) Patent No.: US 7,578,340 B2
(45) Date of Patent: Aug. 25, 2009

(54) HEAT EXCHANGER

(75) Inventors: Uwe Förster, Erdmannhausen (DE); Kurt Molt, Bietigheim-Bissingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 275 days.

(21) Appl. No.: 10/552,041

(22) PCT Filed: Mar. 22, 2004

(86) PCT No.: PCT/EP2004/003016

§ 371 (c)(1),
(2), (4) Date: Oct. 3, 2005

(87) PCT Pub. No.: WO2004/088234

PCT Pub. Date: Oct. 14, 2004

(65) Prior Publication Data

US 2006/0266509 A1 Nov. 30, 2006

(30) Foreign Application Priority Data

Apr. 3, 2003 (DE) ..... 103 15 371

(51) Int. Cl.
*F28F 9/02* (2006.01)
*F28D 1/02* (2006.01)

(52) U.S. Cl. ..... 165/173; 165/174; 165/153

(58) Field of Classification Search ..... 165/173–176, 165/178, 153, 110
See application file for complete search history.

(56) References Cited

U.S. PATENT DOCUMENTS 4,917,180 A * 4/1990 Wolf et al. ..... 165/150
4,971,145 A 11/1990 Lyon
5,090,477 A * 2/1992 Sprow et al. ..... 165/150
5,172,761 A 12/1992 Lyon
5,537,839 A 7/1996 Burk et al.
6,155,340 A * 12/2000 Folkedal et al. ..... 165/175
6,176,303 B1 * 1/2001 Kobayashi et al. ..... 165/175
6,216,776 B1 * 4/2001 Kobayashi et al. ..... 165/173
6,340,055 B1 1/2002 Yamauchi et al.
6,446,713 B1 9/2002 Insalaco
6,640,887 B2 * 11/2003 Abell et al. ..... 165/175
6,745,827 B2 * 6/2004 Lee et al. ..... 165/144
7,121,332 B2 * 10/2006 Forster et al. ..... 165/174
2002/0074113 A1 6/2002 Abell et al.
2002/0134538 A1 * 9/2002 Moreau ..... 165/173
2003/0159813 A1 * 8/2003 Baldantoni ..... 165/140

FOREIGN PATENT DOCUMENTS

DE 42 38 853 A1 5/1994
DE 199 06 289 A1 8/1999
WO WO 98/51983 A1 11/1998

* cited by examiner

*Primary Examiner*—Tho v Duong
(74) *Attorney, Agent, or Firm*—Foley & Lardner LLP

(57) ABSTRACT

The invention relates to a heat exchanger, especially a gas cooler for CO2, embodied as a cooling agent. The heat exchanger comprises at least one two-part collector unit made of a base and a cover. Said collector unit consists of flat pipes and at least two longitudinal channels with an essentially circular cross-section. The ends of the flat pipes and the base comprise openings for receiving the ends of the pipes. The base, cover and flat pipes are soldered together.

15 Claims, 5 Drawing Sheets

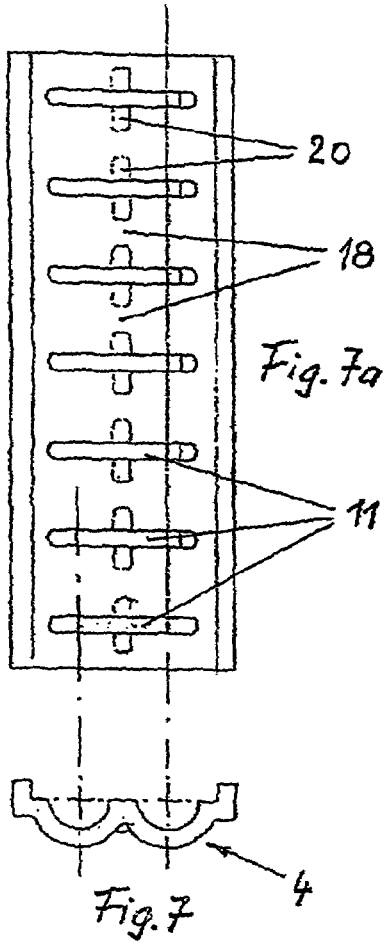
Fig. 7a
Fig. 7
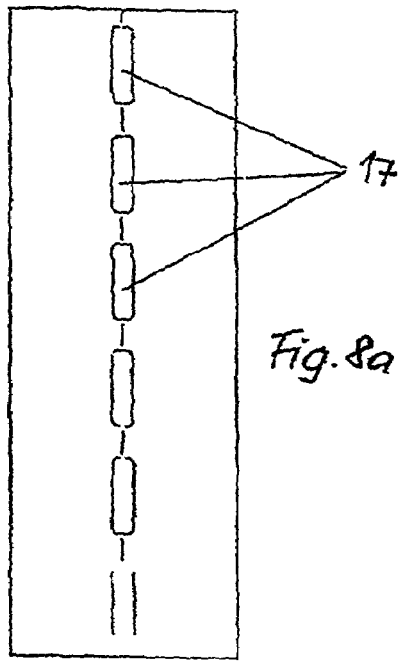
Fig. 8a
Fig. 8
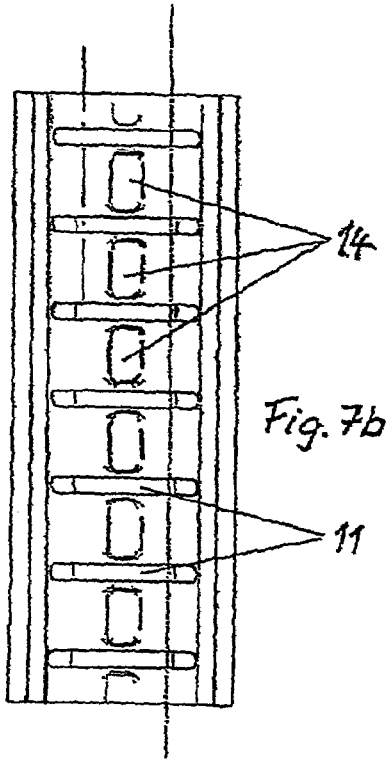
Fig. 7b
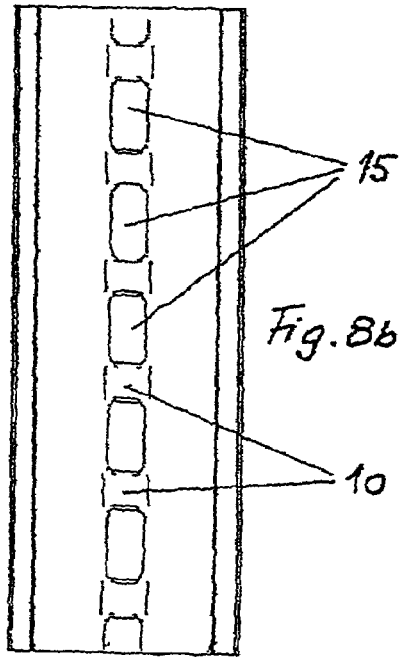
Fig. 8b

HEAT EXCHANGER

BACKGROUND OF THE INVENTION

The invention relates to a heat exchanger.

Heat exchangers for air-conditioning systems using R134a as refrigerant comprise a heat exchanger network made up of flat tubes and corrugation fins, as well as collection tubes which are arranged on both sides of the network and are preferably circular in cross section, as are known from DE-A 42 38 853 in the name of the present Applicant. Designs of this type have a sufficient strength to cope with the pressures which occur in a condenser. However, with more recent refrigerants, such as $CO_2$, the pressures are considerably higher and the conventional designs of heat exchangers are no longer able to cope with such pressures. Therefore, in the extruded collection tube of increased wall thickness disclosed by WO 98/51983, it has been proposed that a collection tube comprise four flow passages of circular cross section arranged next to one another. An extruded collection tube of this type is expensive to produce, on account of the tooling required. Another type of collection tube for high internal pressures has been proposed in DE-A 199 06 289, in which the collection tube is assembled from two or three extruded or pressed parts and has two longitudinal passages which are circular in cross section. If this known collection tube is composed of extruded parts, the relatively high tooling costs are disadvantageous; if the known collection tube is composed of pressed parts, the shape appears to be incomplete, i.e. inadequately adapted to the expected stresses caused by the high internal pressure.

A further design of the header of a conventional condenser has been disclosed by U.S. Pat. No. 5,172,761. The condenser has flat tubes which are received in slot-like openings in a substantially planar but profiled tube plate. A substantially planar but also profiled cover part is connected to the tube plate. The tube plate and cover form individual chambers which are divided by transverse walls and in which the refrigerant flows or is diverted. Although the tube plate and cover are brazed to one another in the region of the tubes by means of inwardly facing stamped formations, this shape of a header does not appear suitable for relatively high pressures, as occur in particular in a $CO_2$ refrigerant circuit.

SUMMARY OF THE INVENTION

It is an object of the present invention to improve a heat exchanger of the type described in the introduction in such a manner, in terms of the design of the header, that it can be produced easily and at low cost and is better able to withstand the high demands in terms of internal pressure.

The header is produced from two stamped or bent sheet-metal plates, i.e. there is no material-removing machining step. This leads to low production costs. Furthermore, the stamping of the metal sheet produces cold work-hardening, which increases the ability of the header to withstand internal pressure. The stamping operation forms longitudinal partitions with contact surfaces and transverse passages both at the cover and at the tube plate, with the contact surfaces each being arranged between the tubes or the openings in the tube plate. When joining the cover and tube plate, the contact surfaces bear flat against one another and thereby form a large number of brazing surfaces in the region of the longitudinal partition. Therefore, the tube plate and cover are brazed, on the one hand, in the edge region and, on the other hand, in the region of the partition, where the brazed contact surfaces form "tie rods", increasing the resistance to the internal pressure which occurs within the header. This creates a pressure-resistant and inexpensive header.

The end sides of the longitudinal passages may, for example, be closed off by stoppers, covers or terminating walls and, if appropriate, then brazed, or may be provided with refrigerant connections. The end sides of the longitudinal passages can also be closed off by suitable deformation of the cover and/or tube plate by them being brazed together. The flat tube ends which project into the tube plate or header are bridged in the region of the longitudinal partition by the curved transverse passages, so that the refrigerant can flow into or out of the flat tubes over the entire cross-sectional region.

According to an advantageous refinement of the invention, the contact surfaces on the inner side of the header are formed as elevations and on the outer side of the header are formed as recesses or stamped indentations, with the recesses or stamped indentations and elevations or stamped projections corresponding to one another in terms of their position. This production and formation of the elevations on the inner side ensures a planar bearing surface and therefore secure and strong brazing.

According to a further advantageous configuration of the invention, the transverse passages, i.e. the connections from one longitudinal chamber to others, are designed as recesses on the inner side and accordingly as elevations on the outer side. The formation of the transverse passages on the inner side ensures free outlet cross sections of the flat tubes and good brazing of the flat tube ends to the inner side, on account of the formation of a meniscus.

In a further configuration of the invention, the wall thickness is approximately constant in the region of the longitudinal partitions of the tube plate and cover, and the elevations and recesses are preferably formed symmetrically with respect to a central parting plane, with a trapezoidal contour as seen in longitudinal section. This design results in a favorable fiber profile for the sheet-metal material and good cold work-hardening, i.e. a high toughness and strength of the header, in particular in combination with the brazed, rectangular contact surfaces between the flat tubes as tie rods. According to another embodiment, the header has a centrally arranged parting plane, and the elevations and recesses are arranged asymmetrically with respect to the parting plane.

According to an advantageous refinement of the invention, the tube plate (or also the cover) has edge strips or tabs in the edge region. The cover and tube plate are therefore fixed by means of the strips or tabs before they are brazed together with the entire heat exchanger.

According to a further advantageous configuration of the invention, there are three or more longitudinal chambers having two or more longitudinal partitions, with the longitudinal partitions being formed analogously to the individual longitudinal partition described above. This allows the header according to the invention to be used even for relatively large depths of flat tube without the longitudinal passages adopting an excessively large diameter. This gives advantages in terms of installation space and the strength of the header.

BRIEF DESCRIPTION OF THE DRAWING

Exemplary embodiments of the invention are illustrated in the drawings and described in more detail in the text which follows, in which:

FIG. 7 shows a cross section through the tube plate of the header, FIG. 7*a* shows a view from below onto the header shown in FIG. 7, FIG. 7*b* shows a view from above onto the header shown in FIG. 7, FIG. 8 shows a cross section through the cover of the header, FIG. 8*a* shows a view from below onto the cover shown in FIG. 8, FIG. 8*b* shows a view from above onto the header shown in FIG. 8.

DETAILED DESCRIPTION OF THE INVENTION

Figure 1:
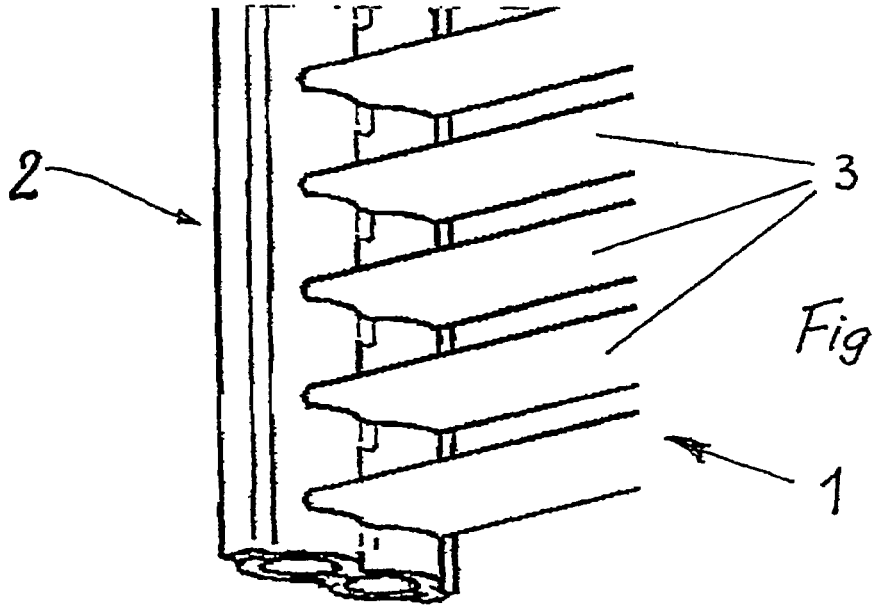
FIG. 1 shows a perspective partial view of a gas cooler.

FIG. 1 shows a heat exchanger which is designed as a gas cooler 1 and has a header 2 and flat tubes 3 which open out into the header and between which corrugation fins (not shown) may be arranged. A gas cooler of this type is used in refrigerant circuits for motor vehicle air-conditioning systems operated with $CO_2$ as refrigerant, but can also be used in general as a pressure-resistant heat exchanger.

Figure 2:
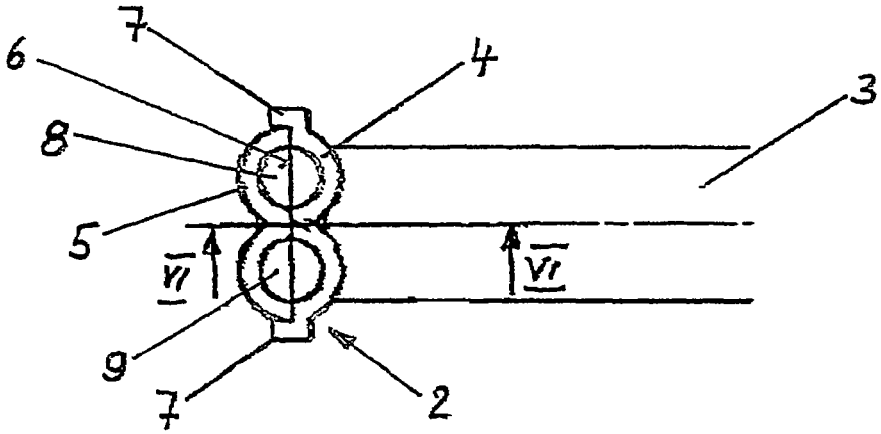
FIG. 2 shows a side view of the gas cooler illustrated in FIG. 1.

FIG. 2 shows a side view of the gas cooler 1 with the header 2 which is composed of a tube plate 4 and a cover 5. The tube plate 4 and cover 5 are approximately W-shaped and formed and arranged symmetrically with respect to a parting plane 6, with the tube plate 4 having edge strips 7 which engage laterally around and fix the cover 5. Tube plate 4 and cover 5 form two longitudinal passages 8, 9, which are both substantially circular in cross section. According to another embodiment, the two longitudinal passage have different cross sections. The flat tubes 3 are received by the tube plate 4 and the ends of the flat tubes project into the longitudinal passages 8, 9 approximately as far as the parting plane 6. The tube plate 4 and cover 5 are cut from a sheet-metal plate (not shown in more detail) and are converted into the form illustrated by stamping or bending, i.e. are produced without the need for a material-removing machining process. After the individual parts, such as flat tubes 3, tube plate 4 and cover 5 have been joined, the entire gas cooler 1, which may also have another header (not shown), is brazed.

Figure 3:
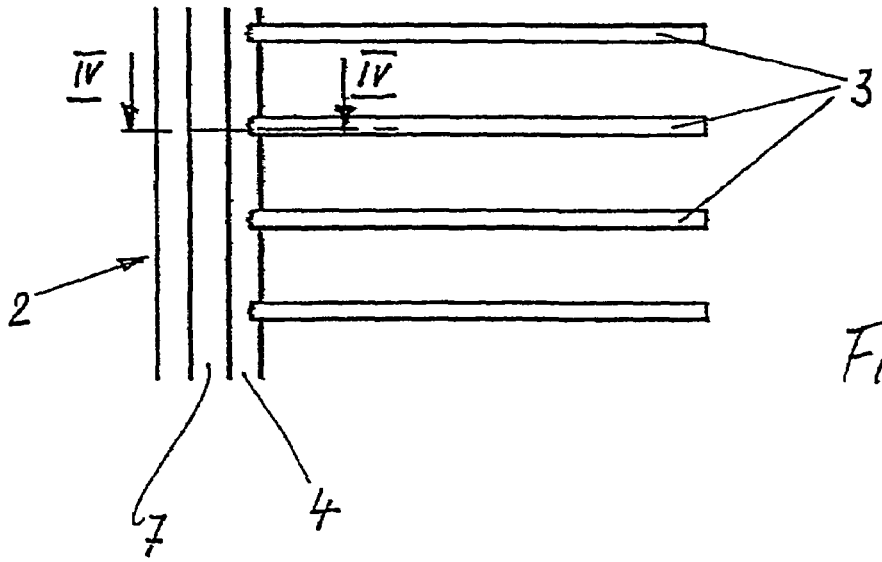
FIG. 3 shows a partial view of the gas cooler shown in FIG. 1 from the front.

FIG. 3 shows a front view of an excerpt from the gas cooler 1, i.e. as seen in the direction of view onto the narrow sides of the flat tubes 3 and the continuous strip 7 of the tube plate 4. Instead of the continuous strip 7, it is also possible to provide individual tabs (not shown), since these substantially only have a fixing function for the subsequent brazing operation. As has already been mentioned, corrugation fins (not shown), over which ambient air flows in a direction perpendicular to the plane of the drawing, may be arranged between the flat tubes 3.

Figure 4:
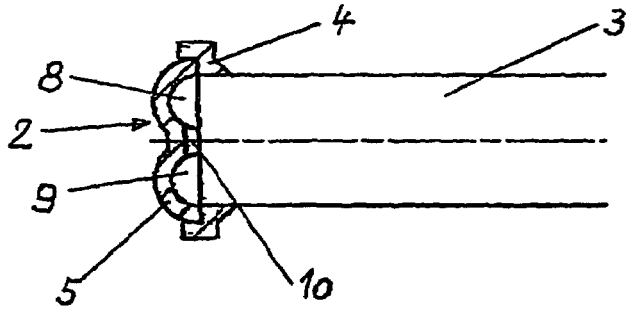
FIG. 4 shows a section on line IV-IV in FIG. 3.

FIG. 4 shows a section on line IV-IV in FIG. 3, i.e. a cross section through the header 2 with tube plate 4 which receives a flat tube 3 (not shown in section). A transverse passage 10, which forms a through-connection, is arranged between the two longitudinal passages 8, 9.

Figure 5:
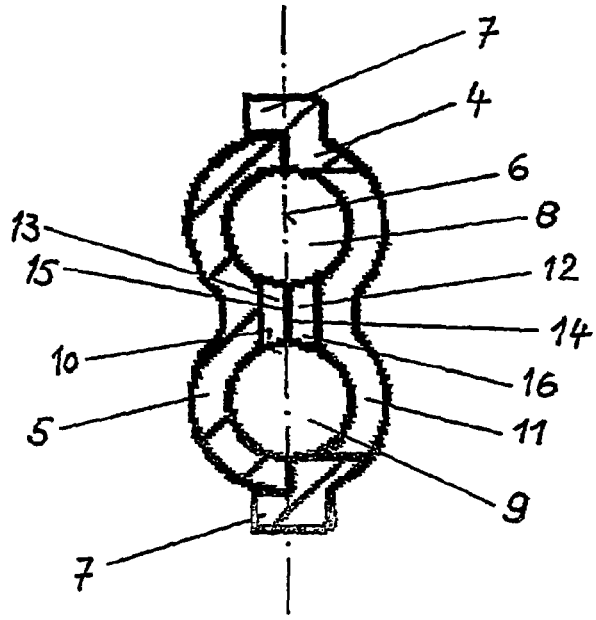
FIG. 5 shows an enlarged section as shown in FIG. 4, but without the flat tube.

FIG. 5 shows an enlarged illustration of the header 2 without the flat tube 3, having a slot-like opening 11 in the tube plate 4 for receiving the flat tubes 3. As has already been mentioned, the header 2 has a parting plane 6, with respect to which tube plate 4 and cover 5, with the exception of the edge strips 7 and the receiving openings 11, are formed approximately symmetrically, in particular in the region of a longitudinal partition which separates the two longitudinal passages and is formed from a longitudinal partition region 12 of the tube plate 4 and from a longitudinal partition region 13 of the cover 5, which form contact surfaces 14, 15 bearing against one another. The contact surfaces 14, 15 which bear against one another are in each case arranged between the flat tubes 3 and therefore lie behind the plane of the drawing, in which the transverse passage 10 and—symmetrically with respect thereto—a further transverse passage 16 are located. The two transverse passages 10, 16 complement one another to form a common passage cross section. According to one embodiment, the two contact surfaces are of different sizes or have different cross sections, in particular in terms of width and/or length.

Figure 6:
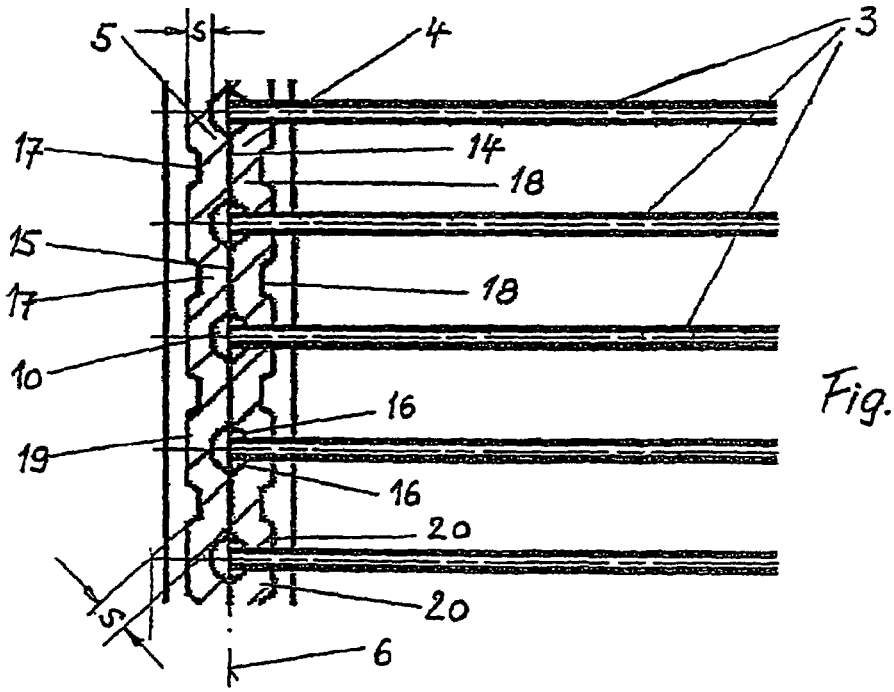
FIG. 6 shows a section on line VI-VI in FIG. 2.

FIG. 6 shows a section on line VI-VI in FIG. 2, i.e. in the region of the longitudinal partition or the two longitudinal partition regions 12, 13. The latter, in the region of the parting plane 6, butt against one another by way of their contact surfaces 14, 15, which are each arranged between the flat tubes 3. The contact surfaces 14, 15 in tube plate 4 and cover 5 are each designed as elevations or stamped projections, opposite each of which there is a recess 17 in the cover or a recess 18 in the tube plate. The transverse passages 10 in the cover 5 are formed by recesses on the inner side, opposite which are elevations 19 in the cover; in a corresponding way, opposite the transverse passages 16 in the tube plate 4 are elevations 20 on the outer side of the tube plate. The elevations and recesses in each case produce a trapezoidally meandering profile with an approximately constant wall thickness s for the longitudinal partition regions 12, 13 of tube plate and cover. Since the elevations and recesses—as has already been mentioned—are produced by stamping, the result here is a favorable fiber profile and high cold work-hardening, which is particularly advantageous for absorbing tensile forces in this region.

FIG. 7 shows a cross section through the tube plate 4, FIG. 7*a* shows a view of the tube plate 4 from below and FIG. 7*b* shows a view of the tube plate 4 from above. The contact surfaces 14, which are approximately rectangular in form, can be seen between the slot-like openings 11 in the tube plate on the inner side of the tube plate 4 in FIG. 7*b*. The recesses 18 lie opposite these contact surfaces 14 on the outer side of the tube plate 4 in FIG. 7*a*. The elevations on the outer side of the tube plate are denoted by 20.

FIG. 8 shows the cover 5 in cross section, FIG. 8*a* shows a view of the cover 5 from below and FIG. 8*b* shows a view of the cover 5 from above, i.e. its inner side. The stamped depressions 17 can be seen as rectangular surfaces in FIG. 8*a*, with the contact surfaces 15 located opposite them as elevations on the inner side of the cover 5 (FIG. 8*b*). The transverse passages 10 extend between the elevations 15.

The contact surfaces 14 (FIG. 7*b*) and the contact surfaces 15 (FIG. 8*b*) approximately correspond to one another in terms of size and position, and after the tube plate 4 and cover 5 have been joined bear against one another and are brazed together in this region. For this purpose, the sheet-metal plates used as starting material for tube plate 4 and cover 5 may be plated with brazing solder on both sides. The base material for the sheet-metal plates and also the flat tubes 3 and, if appropriate, the corrugation fins is an aluminum alloy or various aluminum alloys.

Figure 9:
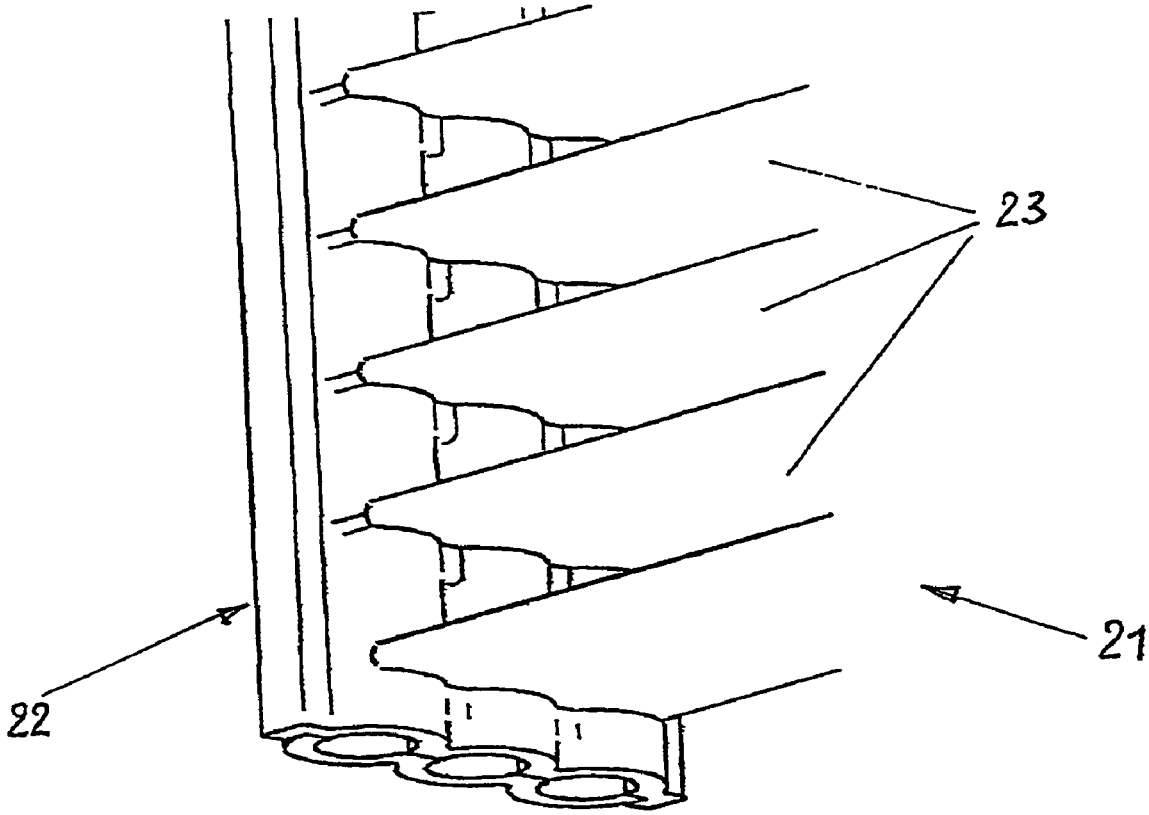
FIG. 9 shows a further exemplary embodiment of the invention with a header having three longitudinal passages.

FIG. 9 shows a further exemplary embodiment of the invention, specifically a gas cooler 21, with a header 22 and a series of flat tubes 23 which are received by the header 22 at the end side.

Figure 10:
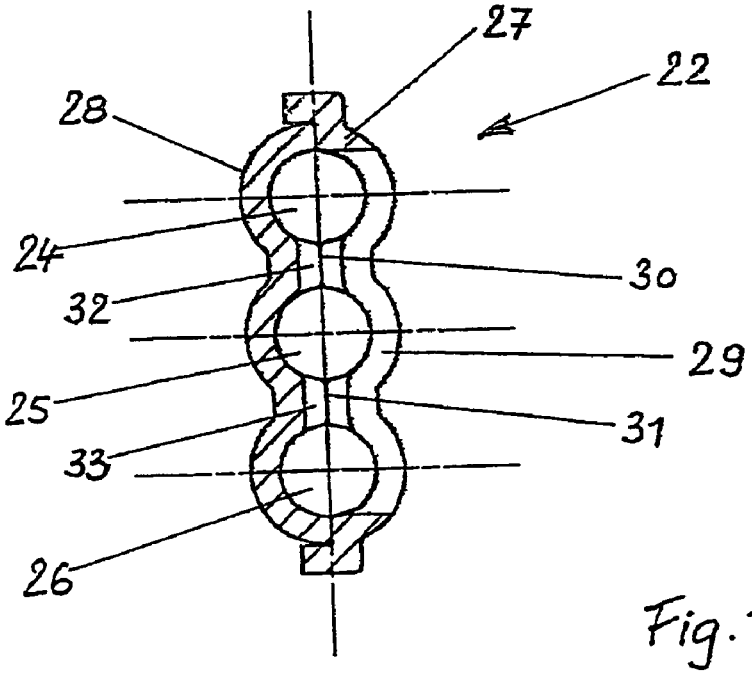
FIG. 10 shows a cross section through the header as shown in FIG. 9, without the flat tube.

FIG. 10 shows the header 22 in cross section without flat tube 23. The header 22 has three longitudinal passages 24, 25, 26 which are formed by a tube plate 27 and a cover 28. A continuous slot 29 having the dimensions of the ends of the flat tubes 23 has been formed in the tube plate 27, preferably by stamping. The longitudinal passages 24, 25, 26 are formed by two longitudinal partitions 30, 31 which are formed similarly to the longitudinal partition described above, comprising longitudinal partition regions of tube plate and cover. Transverse passages 32 and 33 are also provided by recesses. The illustration reveals that the header according to the invention can be designed with any desired number of longitudinal passages, with the contact surfaces according to the invention for forming tie rods in each case being provided between two adjacent longitudinal passages.

Figure 11:
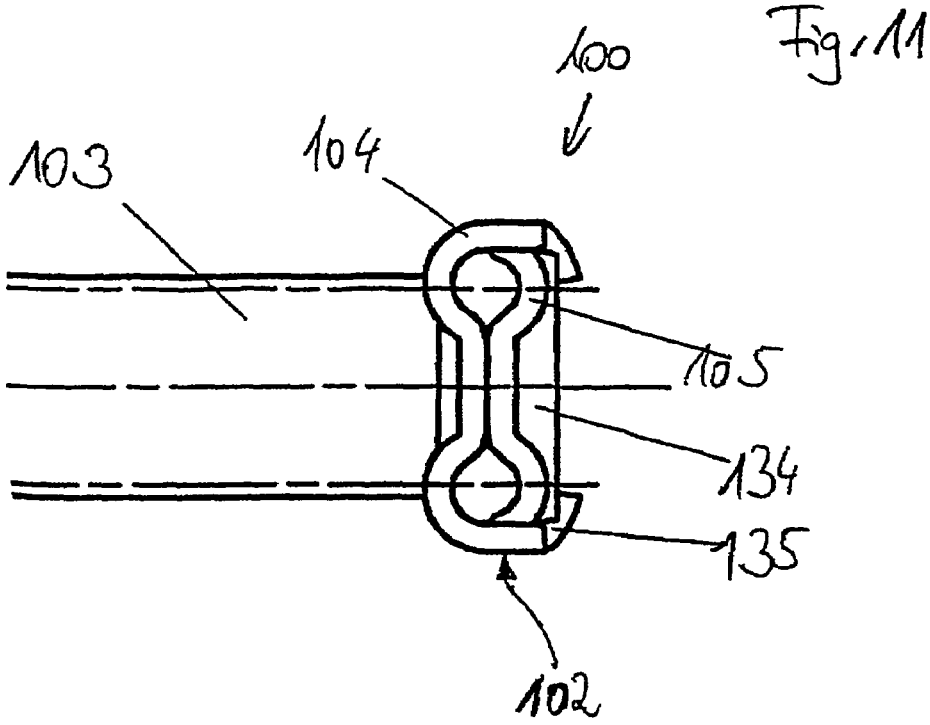
FIG. 11 shows a cross section through the header with the flat tube.

FIG. 11 shows a section through a collection tube of a gas cooler 100 having the header 102, which is also referred to as a collection tube. The header is of two-part configuration and is composed of a tube plate 104 and a cover 105. The cover 105 is fitted into the tube plate. This is carried out in such a way that the side arms of the tube plate engage around the cover, so that side faces of the cover bear against inner surfaces of the tube plate. Tabs 135, which can be deformed prior to the brazing process in order to secure the cover in the tube plate, are advantageously arranged on the tube plate. Partitions 134 can be introduced, for example pushed, into openings in the cover in order to divide the collection tubes. These partitions can likewise be secured by means of tabs. The partitions are advantageously approximately B-shaped in form and bear against the contour of the tube plate. Tube plate 104 and cover 105 form at least two, optionally also 3, 4 or more, longitudinal passages, which are both substantially circular or oval in cross section. The flat tubes 103 are received by the tube plate 104, and their flat tube ends project into the longitudinal passages, approximately as far as a parting plane. Tube plate 104 and cover 105 are cut out of a sheet-metal plate (not shown) and converted into the shape illustrated by stamping or bending, i.e. produced without the need for a material-removing machining process. However, the production process may also be carried out in a different order, i.e. first of all the sheet-metal plate is deformed, and then the tube plate or cover is punched out. After the individual parts, such as flat tubes 103, tube plate 104 and cover 105, have been joined, the entire gas cooler 1, which may also include another header (not shown), can be brazed.

Figure 12:
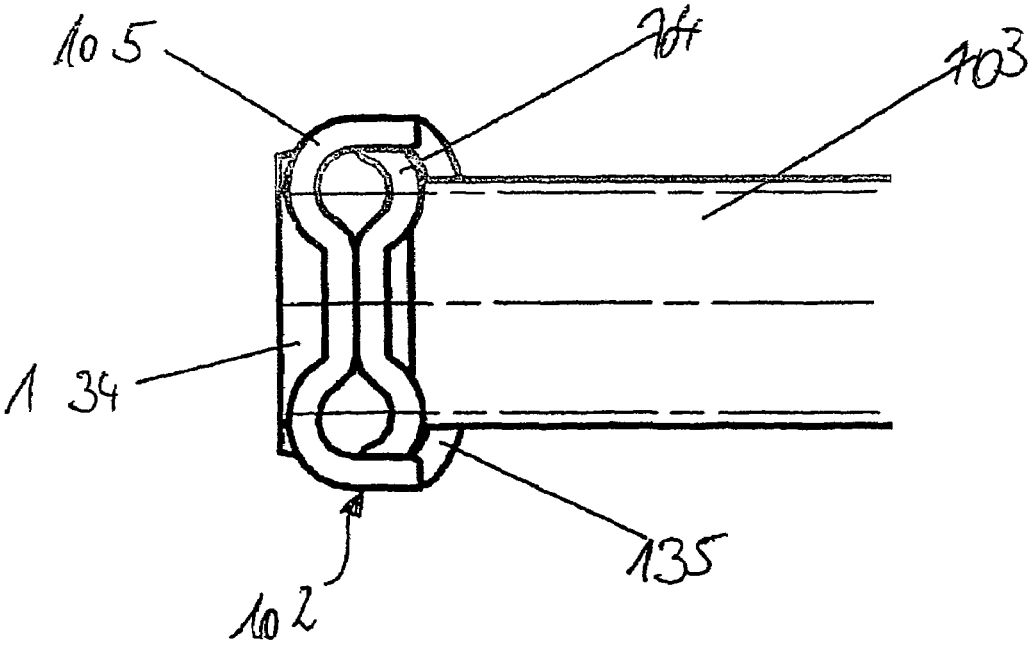
FIG. 12 shows a cross section through the header with the flat tube.

FIG. 12 shows a further exemplary embodiment of the invention, in which the configuration of tube plate and cover are similar to in FIG. 11, except that in FIG. 12 the tube plate and cover have been swapped over, i.e. in FIG. 12 the side arms of the cover engage around the outside of the tube plate, and the tabs are formed on the arms of the cover. Another advantage in this case is that the tabs can come to bear laterally against the tubes 103 and/or may be arranged between two tubes.

In both cases, i.e. FIG. 11 and FIG. 12, the tube plate and cover have two approximately semicircular regions which are connected by an approximately straight portion. Arms which are oriented approximately perpendicular with respect to the central region are provided on the parts, such as tube plate or cover, which engage around the respective other part.

It is also possible for further components, such as flanges or the like, to be connected to the tabs 135.

LIST OF DESIGNATIONS

1, 100 Gas cooler
2, 102 Header
3, 103 Flat tube
4, 104 Tube plate
5, 105 Cover
6 Parting plane
7 Edge strip
8 Longitudinal passage
9 Longitudinal passage
10 Transverse passage
11 Opening in the tube plate
12 Longitudinal partition region, tube plate
13 Longitudinal partition region, cover
14 Contact surface, tube plate
15 Contact surface, cover
16 Transverse passage
17 Recess, cover
18 Recess, tube plate
19 Elevation, cover
20 Elevation, tube plate
21 Gas cooler
22 Header
23 Flat tube
24 Longitudinal passage
25 Longitudinal passage
26 Longitudinal passage
27 Tube plate
28 Cover
29 Slot
30 Longitudinal partition
134 Longitudinal partition
135 Tab

The invention claimed is:

1. A heat exchanger, comprising:

a two-part header, wherein the two-part header comprises a tube plate and a cover meeting at a parting plane, wherein the tube plate and cover are formed substantially symmetrically with respect to the parting plane, with each of the tube plate and cover including at least two approximately semicircular regions that cooperate to form at least two longitudinal passages which are substantially circular in cross section; and a plurality of flat tubes, wherein the tube plate has a plurality of openings for receiving ends of the plurality of flat tubes, wherein each of the tube plate and the cover is produced from a flat metal sheet and has at least one central longitudinal partition region separating each of the at least two approximately semicircular regions, said partition region forming between adjacent tubes at least one transverse passage, and at least one contact surface, wherein the contact surfaces of the tube plate and the cover are brazed together, wherein the tube plate, the cover, and the plurality of flat tubes are brazed together, and wherein the transverse passages are in a form of symmetrically stamped recesses on inner sides of the tube plate and the cover with respect to the parting plane, with corresponding elevations on outer sides of the tube plate and the cover.

2. The heat exchanger as claimed in claim 1, wherein the contact surfaces of the tube plate and cover are formed as elevations on inner sides of the tube plate and cover with corresponding recesses on outer sides of the tube plate and cover.

3. The heat exchanger as claimed in claim 2, wherein the tube plate and the cover have an approximately constant wall thickness in the region of the elevations and recesses forming the transverse passages and contact surfaces.

4. The heat exchanger as claimed in claim 2, wherein the elevations and recesses forming the transverse passages and contact surfaces are arranged symmetrically with respect to the parting plane.

5. The heat exchanger as claimed in claim 2, wherein the elevations and recesses forming the transverse passages and contact surfaces form a trapezoidal profile when seen in longitudinal section.

6. The heat exchanger as claimed in claim 5, wherein the respective contact surfaces of the tube plate and the cover comprise substantially flat surfaces.

7. The heat exchanger as claimed in claim 6, wherein the contact surfaces are formed as approximately rectangular surfaces.

8. The heat exchanger as claimed in claim 1, wherein the cover and the tube plate each have an edge region, wherein the edge regions are brazed together.

9. The heat exchanger as claimed in claim 8, wherein the edge region of the tube plate comprises edge strips, tabs, or a combination thereof.

10. The heat exchanger as claimed in claim 8, wherein the edge region of the tube plate engages over the edge region of the cover.

11. The heat exchanger as claimed in claim 8, wherein the edge region of the cover comprises edge strips, tabs, or a combination thereof.

12. The heat exchanger as claimed in claim 8, wherein the edge region of the cover engages over the edge region of the tube plate.

13. The heat exchanger as claimed in claim 1, wherein the header comprises at least three longitudinal passages and at least two longitudinal partition regions.

14. The heat exchanger as claimed in claim 1, wherein the heat exchanger is configured to be a gas cooler or a condenser.

15. The heat exchanger as claimed in claim 1, wherein the tube plate and the cover are formed by stamping.

* * * * *